US005839631A

United States Patent [19]

Hebert et al.

[11] Patent Number: 5,839,631

[45] Date of Patent: Nov. 24, 1998

[54] CLOTH GOLF BALL HOLDER

[76] Inventors: Luc Hebert, 5345 Rang des Etangs; Monique Hebert, 2856 Principal, both of St. Jean Baptiste, Quebec, Canada, JOL 2B0

[21] Appl. No.: 856,221

[22] Filed: May 14, 1997

[51] Int. Cl.[6] ..... A45F 5/00

[52] U.S. Cl. ..... 224/251; 224/918; 224/919; 224/235; 383/41; 383/72; 206/315.9; D3/257

[58] Field of Search ..... 224/919, 676, 224/677, 235, 251, 191, 918, 250, 223; 383/41, 42, 43, 67, 71, 72, 75, 906; 206/315.1, 315.9; D3/221, 229, 254, 257; 221/303, 304, 307, 185

[56] References Cited

U.S. PATENT DOCUMENTS

| | | | |
|---|---|---|---|
| D. 322,170 | 12/1991 | Nelson et al. | D3/221 |
| 1,778,225 | 10/1930 | Morss | 224/919 |
| 4,739,880 | 4/1988 | Sawyer et al. | 383/72 |
| 4,886,196 | 12/1989 | Plummer | 224/919 |
| 5,341,933 | 8/1994 | Willows | 383/43 |
| 5,451,108 | 9/1995 | Anderson | 383/41 |
| 5,641,103 | 6/1997 | Potik et al. | 224/251 |
| 5,683,312 | 11/1997 | Boehm et al. | 473/354 |

FOREIGN PATENT DOCUMENTS

| | | | |
|---|---|---|---|
| 2268157 | 1/1994 | United Kingdom | 383/41 |

*Primary Examiner*—Allan N. Shoap
*Assistant Examiner*—Gregory M. Vidovich
*Attorney, Agent, or Firm*—Eric Fincham

[57] ABSTRACT

There is provided a holder for a plurality of golf balls, the holder having a cylindrical sleeve formed of a flexible fabric sheet material and having an open first end and an open second end. About a first end of the sleeve there is a drawstring which may be tightened after the balls have been inserted through the first end while a second end has an elastic material thereabout, the elastic material narrowing the opening to a diameter less than the diameter of a golf ball but permitting the opening to expand to permit the removal of a golf ball when desired. The holder is, inexpensive, easy to manufacture and may be utilized as a promotional item.

4 Claims, 2 Drawing Sheets

CLOTH GOLF BALL HOLDER

BACKGROUND OF THE INVENTION

The present invention relates to a golf ball holder and more particularly, relates to a golf ball holder for retaining a plurality of golf balls in an attractive and inexpensive holder.

There are a number of known golf ball holders or containers known in the art. Thus, in U.S. Pat. No. 4,678,108, there is shown a tubular golf ball carrier of a rigid plastic material. The tubular carrier has a sight opening in the side but which does not permit removal. The balls are removed either through a top aperture or a bottom aperture with the apertures being sized for either a British sized golf ball or a U.S.G.A. golf ball. At the top or bottom, there is provided a thin flexible annular ring. The carrier, having several different components, would be relatively expensive to manufacture.

A combination golf ball and tee holder is shown in U.S. Pat. No. 2,558,382. In this arrangement, the golf balls are held in a pouch and the pouch may be carried on the belt of the golfer.

While the above arrangements and many others shown in the art function as a golf ball holder and tee holder, it would be desirable to have a golf ball and tee holder which would be inexpensive to manufacture so that it could be used for promotions and the like and particularly when it would be suitable for having a graphics and the like applied thereto for promotional purposes.

SUMMARY OF THE INVENTION

It is therefore an object of the present invention to provide a combination golf ball and tee holder wherein the holder can be manufactured very inexpensively and would be suitable for use as a promotional item.

According to one aspect of the present invention, there is provided a holder for at least one golf ball, the holder comprising a cylindrical sleeve having an open first end and an open second end, the sleeve being formed of a flexible fabric sheet material, first and second marginal edges of said flexible fabric sheet material being secured together along an axial length of the sleeve, a first end of the sleeve having a channel formed by the fabric about the open first end, a drawstring within the channel and extending through the opening to the channel, a second end of the sleeve having a channel formed adjacent to the opening, an elastic material within the second channel, the elastic material narrowing the opening to a diameter less than the diameter of the golf ball, and wherein the elastic material permits the opening to expand to thereby permit the removal of the golf ball and to reduce the size of the opening to a diameter less than the diameter of the golf ball after the golf ball has been removed therethrough.

In a greater detail, the holder of the present invention, as mentioned above, is formed of a flexible fabric sheet material. Many such materials are known in the art and can be utilized, with the material having the properties of being capable of being printed thereon, being washable and relatively resistant to soiling. The preferred materials include various cotton/polyester blends.

The fabric sheet material would normally be formed to have a rectangular configuration with side marginal edges being secured together to thereby form a cylindrical tube or sleeve. Various means of securing the side marginal edges together may be utilized including stitching, adhesive, ultrasonic welding, etc. The seam is preferably such that the free marginal edges extend interiorly for esthetic purposes. The sleeve or tube is sized to be approximately or slightly larger than the diameter of the golf balls to be received.

The sleeve is designed to receive printing, which printing may comprise any suitable means. The relatively inexpensive cost of the holder of the present invention would provide for the printing of logos and other promotional material thereon.

At the first end of the tubular sleeve, there is provided an opening which functions as the inlet for the insertion of golf balls into the tubular holder. As such, the opening is sized to be slightly larger than the diameter of the golf balls to be received.

At the opening of the first end, there is preferably provided a channel designed to receive a drawstring for opening and closing of the opening. Again, the channel may be conveniently provided by an interior folding over of the marginal edge of the fabric material and stitching of the same.

The drawstring may be formed of any suitable cordlike material and preferably includes a locking mechanism to retain the drawstring in a closed position.

At the second opening, there is provided means to restrict the size of the opening and to this end, there may be provided a channel formed in a manner similar to that described above with respect to the first end. Inside the channel there is elastic material which is sized to maintain the opening of a size less than the diameter of the golf ball while being expandable or stretchable to a size to permit the passage of a golf ball therethrough.

In the preferred embodiments, the golf ball holder also includes means for storing tees and to this end, one or more elastic loops may be incorporated along the seam line of the holder.

BRIEF DESCRIPTION OF THE DRAWINGS

Having thus generally described the invention, reference will be made to the accompanying drawings wherein.

DESCRIPTION OF THE PREFERRED EMBODIMENTS

Figure 1:
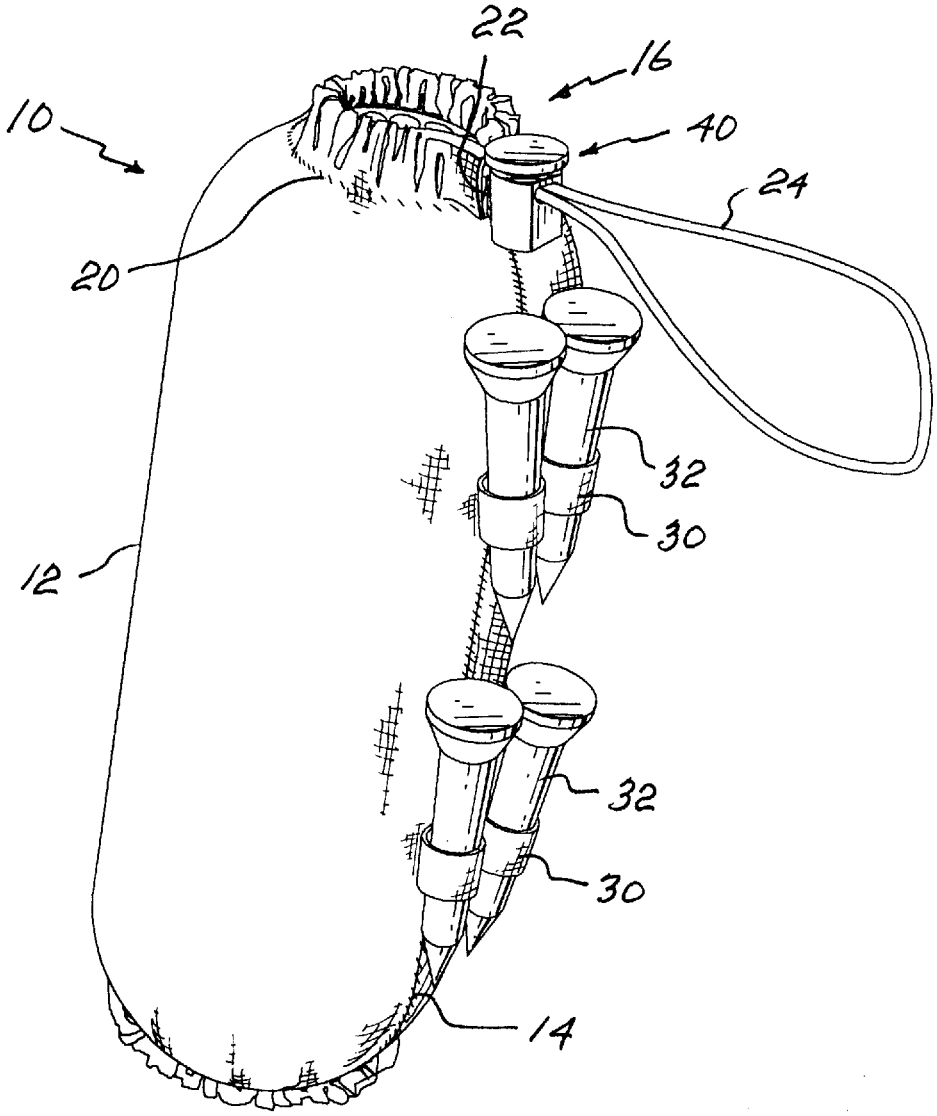
FIG. 1 is a perspective view of a golf ball holder having a plurality of golf balls therein.

Referring to the drawings in greater detail and by reference characters thereto, there is illustrated a holder generally designated by reference numeral 10. Holder 10 has a cylindrical body 12 which is formed of a flexible fabric material joined together by means of stitching 14.

At an upper end generally designated by reference numeral 16, the fabric is folded over on itself to create a channel 22 with the fabric being stitched at stitching line 20. A drawstring 24 is provided within channel 22 such that after the golf balls are inserted, drawstring 24 may be tightened to prevent egress of the golf balls.

Figure 6:
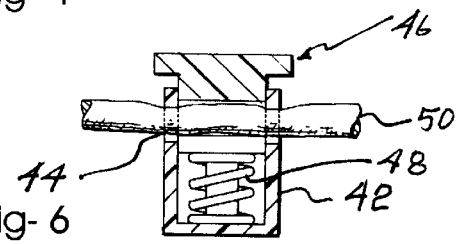
FIG. 6 is a partial cross sectional view of a locking device for a drawstring.

A locking mechanism generally designated by reference numeral 40 may be utilized to maintain drawstring 24 in a closed position. To this end, and as seen in FIG. 6, locking device 40 may include a lower cylindrical body 42 having an aperture 44 in its side walls. An upper member 46 likewise has an aperture in a side wall; upper member 46 is biased upwardly by means of spring 48. Drawstring 24 is designed to pass through the apertures and the upward pressure exerted by spring 48 will retain drawstring 24 in a tightened position.

At a lower end generally designated by reference numeral 18, there is likewise provided a line of stitching 26 to thereby provide a channel 25. Within channel 25 there is provided an elastic strip 28. Elastic strip 28 is sized so as to ordinarily prevent the egress of the golf balls from bottom or lower end 18 as shown in FIG. 2.

Mounted along line of stitching 14 are a plurality of elastic loops 30 designed to retain tees 32.

Figure 2:
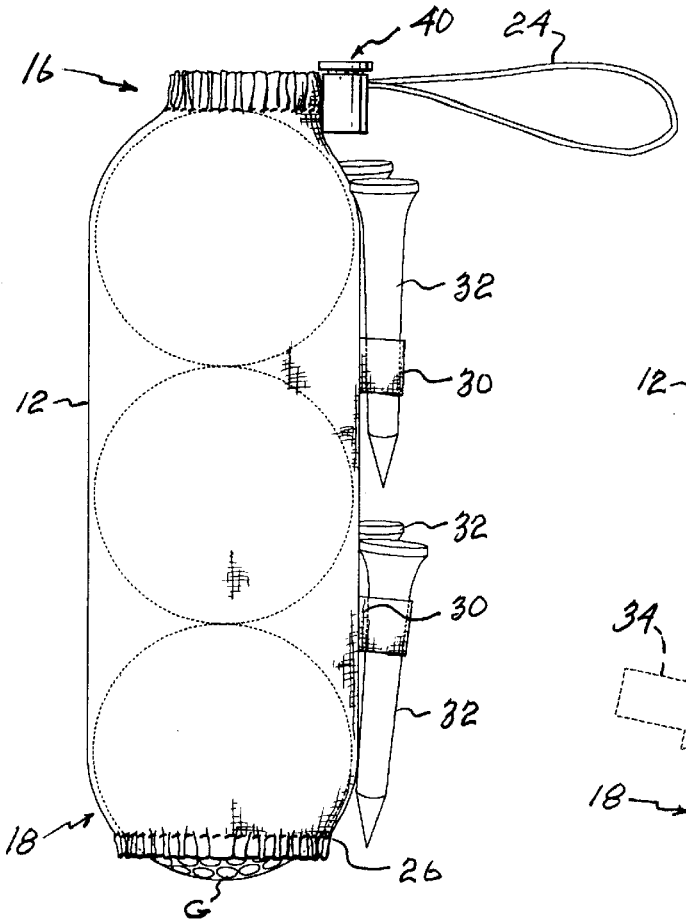
FIG. 2 is a side elevational view thereof.
Figure 3:
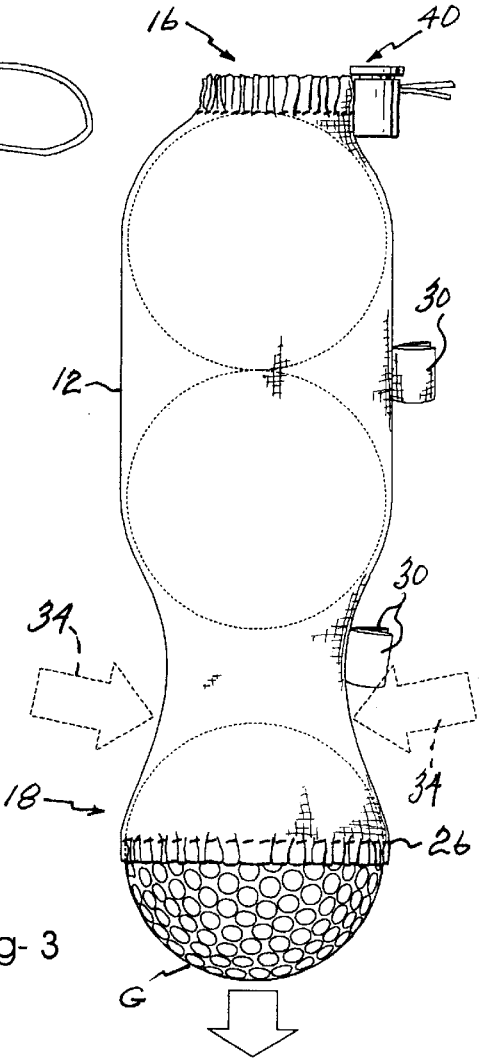
FIG. 3 is a side elevational view similar to FIG. 2 showing removal of a golf ball from the holder.
Figure 4:
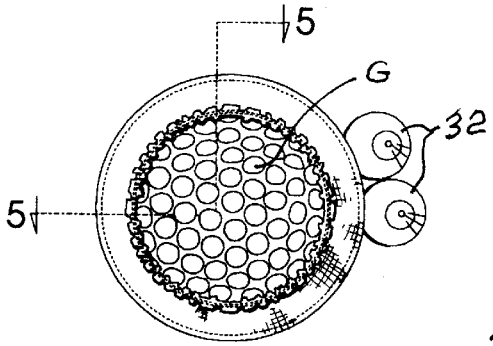
FIG. 4 is a bottom view thereof.
Figure 5:
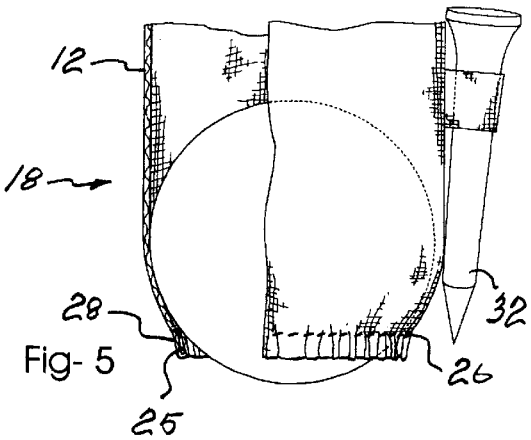
FIG. 5 is a partial view of the bottom portion, partially in a cutaway.

As therefore mentioned, golf balls G may be inserted within cylindrical body 12 at upper end 16 and then drawstring 24 is tightened to the position shown in FIGS. 2 and 3. When a golf ball is desired, pressure may be exerted on cylindrical body 12 as indicated by arrows 34 such that the lowermost golf ball may exit from lower end 18 past elastic strip 28.

It will be understood that the above described embodiment is for purposes of illustration only and that changes and modifications may be made thereto without departing from the spirit and scope of the invention.

We claim:

1. A holder for at least one golf ball, said holder comprising a cylindrical sleeve having an open first end and an open second end;

said sleeve being formed of a flexible fabric sheet material having first and second side marginal edges, said first and second side marginal edges of said flexible fabric sheet material being secured together along an axial length of said sleeve;

said open first end of said sleeve having a channel formed adjacent thereto, a drawstring within said channel to substantially close said open first end, said open second end of said sleeve having a second channel formed adjacent thereto, an elastic material within said second channel, said elastic material narrowing said open second end to a diameter less than the diameter of said at least one golf ball, said elastic material permitting said open second end to expand to permit the removal of said at least one golf ball therethrough and to reduce said open second end to a diameter less than the diameter of said at least one golf ball after said at least one golf ball has been removed therethrough, and tee retaining means comprising at least one loop of elastic material retained between said first and second side marginal edges of said sheet material.

2. The holder of claim 1 wherein said flexible fabric sheet material is a cotton/polyester blend.

3. The holder of claim 1 wherein said side marginal edges of said flexible fabric sheet material are secured together by stitching.

4. The holder of claim 1 further including means for retaining said drawstring in a closed position.

* * * * *